US007406988B2

(12) United States Patent
Mitchell

(10) Patent No.: US 7,406,988 B2
(45) Date of Patent: Aug. 5, 2008

(54) NOZZLE INTERCONNECT

(75) Inventor: Thomas O. Mitchell, Maryland Heights, MO (US)

(73) Assignee: Husky Corporation, Pacific, MO (US)

( * ) Notice: Subject to any disclaimer, the term of this patent is extended or adjusted under 35 U.S.C. 154(b) by 0 days.

(21) Appl. No.: 11/417,606

(22) Filed: May 4, 2006

(65) Prior Publication Data

US 2006/0249225 A1 Nov. 9, 2006

Related U.S. Application Data

(60) Provisional application No. 60/678,583, filed on May 6, 2005.

(51) Int. Cl.
*B65B 1/30* (2006.01)

(52) U.S. Cl. ..... 141/208; 141/206; 141/392

(58) Field of Classification Search ..... 14/192, 14/206–209, 217, 392
See application file for complete search history.

(56) References Cited

U.S. PATENT DOCUMENTS

| | | | | |
|---|---|---|---|---|
| 3,502,121 A | | 3/1970 | Moore et al. | |
| 3,719,215 A | | 3/1973 | Murray | |
| 3,982,571 A | * | 9/1976 | Fenton et al. | 141/225 |
| 4,697,624 A | * | 10/1987 | Bower et al. | 141/208 |
| 5,121,777 A | | 6/1992 | Leininger et al. | |

* cited by examiner

*Primary Examiner*—Timothy L. Maust
(74) *Attorney, Agent, or Firm*—Paul M Denk

(57) ABSTRACT

An interconnect for a fuel dispensing nozzle which provides for sustained shut off of a nozzle when its spout is not inserted into the fill pipe of a fuel tank. When the spout inserts within the fill pipe its bellows or splashguard is forced rearwardly, for urging an interconnecting rod to move rearwardly, against the bias of a spring, to force a pivotal link to disengage from the automatic shut-off diaphragm, to allow it to function normally. But when the nozzle is removed from the fuel tank, the pivotal link contacts against the diaphragm structure, of the automatic shut-off, and prevents the nozzle from dispensing or delivering any fuel from the dispenser.

3 Claims, 4 Drawing Sheets

NOZZLE INTERCONNECT

CROSS REFERENCE TO RELATED APPLICATION

This non-provisional application claims priority to the provisional application for patent Ser. No. 60/678,583 which was filed on May 6, 2005.

BACKGROUND OF THE INVENTION

This invention relates generally to a fuel dispensing nozzle, and more specifically relates to a nozzle incorporating a safety feature that assures that when a fuel dispensing nozzle is removed from the fill pipe of a vehicle, the nozzle will shut off, and prevent any further fuel dispensing, until such time as it is reintroduced into another vehicle fill pipe, in preparation for further fuel dispensing.

The dispensing of gasoline or other fuels from fuel dispensing nozzles, as anyone knows who is familiar with the technology of this art, is a very complex and technically sophisticated field, evidenced by the numerous minutely shiftable and moving parts that are integrated into the structure of such a nozzle, to keep it working effectively. The nozzles, and their various operations, are very sensitive to the venturi and related pressures and vacuums generated within the nozzle, during its operations, in order to keep it dispensing, to furnish an automatic shut-off, and in some instances, and to assure that a high efficiency of vapor recovery is maintained, during their operations. If any one of the foregoing cannot be achieved, CARB and the related governmental regulatory agencies will ban the use of any nozzle, and shut down any business, if not an entire industry, if they do not think that their regulations are being closely followed, and the limits achieved. In addition to the foregoing, the manufacturer is always confronted with its primary concern, aside from all the other governmental or quasi-governmental regulations, and that is to assure the safety of the customer, so that no one gets injured, in any way, when dispensing gasoline into their vehicle, particularly at the self-service installation.

On occasion, episodes have occurred where customers have sustained injury, while dispensing fuel, and while in certain instances it just cannot be determined what are the factual circumstances that lead towards someone sustaining any injury, while dispensing fuel at a service station or convenience stop, in many instances, the sustaining of damages can be attributed to either the mishandling by the customer, or outright negligence, or even intentional misconduct, that leads towards a faulty application and usage of the nozzle, while dispensing fuel, and such activity can be determined as the most likely cause of the mishap that leads towards the injury, in the first instance. Nevertheless, when such occurs, and regardless of the circumstances, the oil company, and the manufacturer of any nozzle, or other fuel dispensing mechanisms, normally sustain the liability, regardless what the facts may be.

Nevertheless, it is always the effort of the manufacturer of these apparatuses, to try to build into their manufactured components, means that will assure safety, and prevent injury, regardless what the circumstances may be that lead up to any damage. Hence, as with this current invention, it is designed to totally shut off the dispensing of any fuel, unless the nozzle is properly in place within the fill pipe of a vehicle, and remains there, and any further manipulation that may cause a premature withdrawal of the nozzle from the vehicle, while dispensing, will result in an immediate shut-off of any further fuel dispensing, so as to attempt to avoid the incidence of any potential injury or liability, regardless what the circumstances are that lead up to such activity. It may be that the vehicle owner, while self-serving in delivery of gasoline into their vehicle, may think that the tank is filled, or that the dispenser has ceased the delivery of gasoline, and therefore withdraw the nozzle from the fill pipe, which unless the dispenser is actually shut off, could lead towards further splashing of gasoline onto the car, onto the surrounding ground, or even onto the person, because of a misjudgment. Perhaps the vehicle owner may have heard the nozzle on the other side of the dispenser shut-off, and inadvertently believed that it was their own nozzle ceasing delivery of fuel to their automobile.

The current invention is designed and intended to alleviate that predicament, to provide for complete shut-off, any time a nozzle is removed from a vehicle, during or after filling, and at the same time, not even allow the dispensing of any fuel from the nozzle, unless it is properly in place within the vehicle fill pipe, in the first instance.

Others have given thought to this predicament. One such embodiment is shown in the United States patent to Moore, et al., U.S. Pat. No. 3,502,121, disclosing a safety mechanism for automatic nozzle. In this embodiment, it includes a trigger cam that interconnects between the front of the nozzle spout, by means of a linkage, that manipulates the stem of the automatic shut-off means, to provide for its shut-off of the nozzle, unless the nozzle spout is inserted within the intake neck of the fuel tank of a vehicle.

The patent to Murray, U.S. Pat. No. 3,719,215, shows another shut-off valve for a liquid dispensing nozzle. The concept of this prior art invention is to require the proper positioning of the spout, of the nozzle, within the vehicle tank, before any fuel can be dispensed from the gasoline dispensing nozzle. Apparently this embodiment incorporates a valve means, that closes off the passage of any air into the shut-off means, which may cause the automatic shut-off means to remain in that position, and prevent the dispensing of any fuel unless the nozzle is properly reinstalled within the vehicle fill pipe.

The patent to Leininger, et al. U.S. Pat. No. 5,121,777, shows another vapor recovery nozzle with sub-assemblies therefor. This embodiment incorporates a control valve that must operate properly before any fuel can be delivered. The bellows of this balanced pressure nozzle must be properly and completely compressed, and sealed, before any fuel can be delivered. Hence, this is just as concerned with the efficient absorption of the fuel vapors, to make sure they are returned to the dispenser, and underground tank, during its operations.

The current invention utilizes different structure, to assure that the nozzle always remains off, until such time as the spout is properly and conveniently located within the fill pipe of the vehicle, before the fuel can be dispensed.

SUMMARY OF THE INVENTION

This invention contemplates the addition of safety features into a fuel dispensing nozzle, to assure that when the nozzle is shut off, or when not in use, or even when removed from usage, will not allow the flow of any further fuel, until such time that the nozzle is properly in place, within a vehicle fill tank, before any dispensing can reoccur. To the contrary, the nozzle allows for the proper dispensing of fuel, when it is being properly utilized, and not otherwise.

In addition, the mechanism utilized in this invention, for achieving the foregoing results, is generally applied to the vapor recovery type of nozzles, that incorporate some type of a boot configuration concentrically overlying a part of the spout, and which nozzles can be used for either balance pressure vapor recovery or the vacuum assist recovery, for the style of nozzles incorporating that type of structure. Even a nozzle with a collapsible splashguard can employ the concept of this invention.

This invention contemplates the addition of structure to various integral components of the dispensing nozzle, so as to provide for cooperation between components that normally do not interact, so that when one particular component is manipulated, during usage of the nozzle, it can control the operation of another component, to assure that the nozzle remains shut off, and inherently provides further safety features to the nozzle, particularly when used by the self service layman.

Essentially, the structure includes a link between the bellows of a balanced pressure nozzle, or even a vacuum assist nozzle that may incorporate a splashguard thereon, or for that matter, any nozzle that incorporates a compressible type of splashguard, and which is compressed or shifted when the nozzle spout is inserted into the fill pipe of a vehicle, so that some relative movement occurs at that region of the nozzle, and which motion can be utilized and translated to other control means, for furnishing regulation to, in this particular instance, the automatic shut-off component of the nozzle, to assure that while the nozzle is in usage, it can be used and applied under normal circumstances for dispensing gasoline to the vehicle, but that when the nozzle is removed, and remains in its inactive state, the nozzle can not be turned on, under any circumstances short of intentional misconduct.

Basically, the invention includes a link, in the form of a rod, that is mounted for longitudinal shifting within the structure of the nozzle, within the region of the venturi, and the automatic shut-off for the nozzle, in its setting. The forward end of the linkage, or the rod means, is in contact with some aspect of the bellows, or collapsible splashguard, regardless what type of nozzle the interconnect is applied to, so that when the spout of the nozzle is inserted into the fill pipe, and the bellows collapses or shifts, under compression, it shifts the rod means rearwardly, for some dimension, during its actuation. The opposite end of the rod means interconnects with a pivotal lever, which, in its steady state or normal position, holds the automatic shut-off opened, so that no gasoline can be dispensed from the nozzle into the vehicle, or elsewhere. On the other hand, when the rod means is shifted rearwardly, through actuation by the efforts of the bellows compressing rearwardly, the pivotal link is repositioned downwardly, generally out of contact with the underside of the automatic shut-off diaphragm, and therefore allows the automatic shut-off means to function under its normal conditions, without obstruction, to allow for the free flow of gasoline, until such time as the automatic shut-off is triggered, and provides for an immediate discontinuance in the flow of fuel, through the nozzle, particularly when the gasoline tank of the vehicle becomes full, and the vacuum blocking means at the end of the spout becomes blocked, and prevents the admission of air from the venturi structure, and in the region of the shut-off diaphragm, thereby causing an immediate tripping, into closure of the nozzle, curtailing fluid flow, through the same. All of the operating components of this particular interconnect are generally concealed within the structure of the nozzle, the user does not even know such a safety feature exists, but nevertheless, functions in response to the standard usage of the nozzle, as when it is located within the fuel tank fill pipe, and provides for clearance of the interconnect to allow the nozzle to be utilized routinely, in dispensing gas, but that when the nozzle is physically removed from the tank, the interconnect, through its rod means and pivotal lever is biased freely forwardly, and therein sustains the upward position of the shut-off diaphragm, to prevent the unauthorized or untimely delivery of gasoline, through the nozzle, as when generally not in such usage. Hence, under the latter circumstance, should someone grasp the nozzle, and attempt to dispense gas, when it is not located within the vehicle's fill pipe, gasoline just cannot be dispensed, because of this type of a block out feature this maintains the nozzle shut off.

It is, therefore, the principal object of this invention to provide a lockout means that prevents the operations of a fuel dispensing nozzle, until such time as the nozzle is fitted into the fill pipe of a vehicle, and its associated bellows presses to disconnect the lockout features of this nozzle.

Another object of this invention is to provide an interconnect for a nozzle that manipulates the automatic shut-off means into a fluid flow preventative setting, that disallows the dispensing of any fluid from the nozzle, unless the nozzle is properly located within the fill pipe of a vehicle.

Still another object of this invention is to provide a further safety feature to the dispensing of fuel, so as to totally prevent the inadvertent, untimely, or even negligent dispensing of fuel, unless the nozzle is properly inserted and located within the vehicle fill pipe, just prior to dispensing.

Still another object of this invention is to provide a nozzle that can be conveniently used for the facile dispensing of fuel, while incorporating an interlock that prevents the untimely flow of fuel, without any knowledge or intentional participation on the part of the user, unless the nozzle is properly installed, for dispensing gasoline into their vehicle.

These and other objects may become more apparent to those skilled in the art upon review of the summary of the invention as provided herein, and upon undertaking a study of the description of its preferred embodiment, in view of the drawings.

DESCRIPTION OF THE PREFERRED EMBODIMENT

Figure 1:
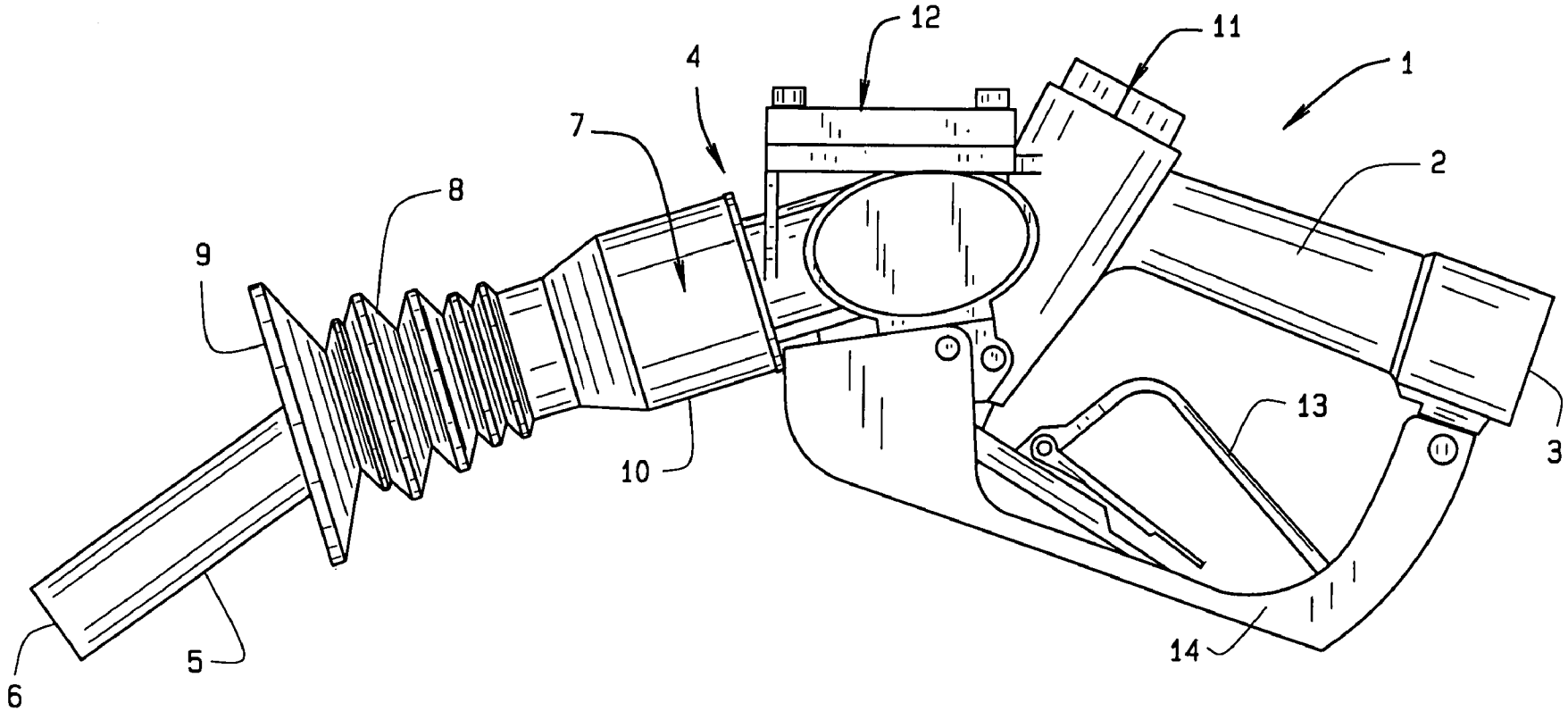
FIG. 1 provides a side view of the dispensing nozzle of this invention.

In referring to the drawings, and in particular FIG. 1, a gasoline dispensing nozzle 1 is readily disclosed. It includes a body 2 having an inlet 3 to which the fuel hose (not shown) is connected. The nozzle also has an outlet 4 communicating with a spout 5 assembly. The spout assembly 5 has a mouth 6 that is insertable into the inlet of a container, such as the fill pipe of the fuel tank into which the liquid is to be dispensed. Disposed within the nozzle body 2, and between its inlet and outlet, is a venturi valve, in the region of 7, internally of the nozzle, as known in the art. With this particular nozzle, there is also included a bellows like member 8, having a splashguard located at its forward region 9, and the bellows includes a mounting section, as at 10, that fits onto the upper region of the spout, which in this particular instance, is capable of longitudinal or axial movement upon the spout, or at least some segment of the member 10 is capable of axial movement, along the upper region of the spout, in order to actuate the interconnect components of this invention, as will be subsequently described. As is also known, the nozzle normally includes a poppet in the region of its housing, as at 11, and in addition, has an automatic shut-off member in the region 12, also to be subsequently described. The handle 13 that provides for opening or closing of the nozzle, to achieve dispensing, is also disclosed within the handle guard 14 for the shown nozzle.

Figure 2:
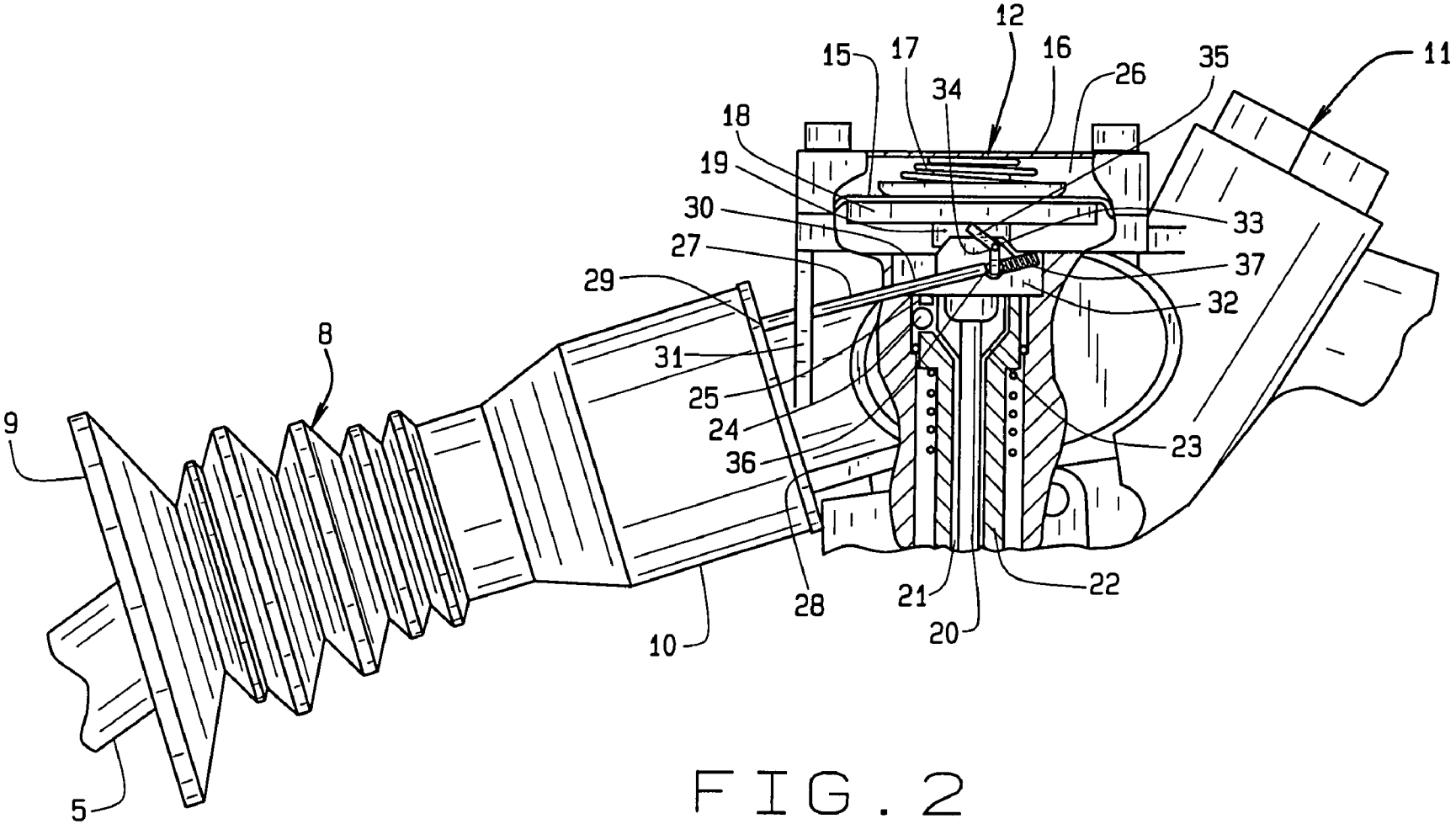
FIG. 2 provides a side view, with partial section, so as to disclose the operative components of this interlock system during application.

As can be seen in FIG. 2, the specific structure of the shut-off means 12 is readily disclosed. As known in the art, it includes a diaphragm member 15 having overlying thereon a backing plate 16 that supports a biasing spring 17 that normally urges the diaphragm downwardly. At the same time, the underside of the diaphragm includes a circular backing plate 18, having a supporting collar 19 thereunder, that adds support to the backing plate 18. Connecting with the backing plate 18, and the collar 19, and secured by means of a threaded fastener (not shown) is a stem 20. The stem rides within a slot, as at 21, provided centrally through the automatic shut-off plunger 22. Generally, the stem at its upper end includes an integral beveled portion 23, which when arranged in the position as shown in FIG. 2, allows for the dispensing of fuel out of the nozzle. Under the circumstances, the plunger 22 is arranged generally upwardly with respect to the stem 20, and its beveled portion 23, such that the interlocking bearings, one as shown at 24, and which normally includes three in number around the perimeter of the stem, and which ride within their respective slots 25 of the plunger, in that position, allows for the dispensing of fuel from the nozzle. In this position, the diaphragm is usually at its lowermost position, again as known in the art. But, as is also known, when a vacuum develops within the chamber 26, such that when the fuel tank becomes filled, the lower venting structure of the spout becomes blocked, and the venturi generates a vacuum within the location 26, this causes the diaphragm 15 to rise upwardly, pulling up its stem 20, thereby allowing the bearings 24 to ride down upon the incline of the bevel 23, which frees the plunger 22 to rapidly descend, shifting the handle, and shutting of the poppet, as within 11, to curtail further flow of fuel through the nozzle. All of this type of structure is known in the art, and is clearly disclosed and explained in detail in the U.S. Pat. No. 5,085,258, listing one of the inventors herein, and which is owned by a common assignee. This prior U.S. Pat. No. 5,085, 258, is incorporated herein by reference.

The concept of this current invention is to provide an interconnect means, between the shifting bellows 8, or more specifically its supporting structure 10, and the diaphragm structure 15, and in this instance, more specifically its backing plate 18, so as to provide an automatic hold off means for the nozzle, to prevent fluid flow, and to achieve the benefits and results as previously summarized. This particular structure includes a length of rod 27 which contacts with the backside 28 of the bellows support 10, as can be seen. Thus, when the bellows, and whether it be the type that is used in a balance pressure vapor return nozzle, or a vacuum assist type that incorporates a splashguard and bellows, as shown in the drawings, or just a shiftable guard, or perhaps on any nozzle, regardless of whether it is a vapor recovery type, or a standard nozzle that has a bellows type splashguard provided upon it, wherein these type of bellows means are capable of shifting upon the spout, then they can be used for displacing the type of rod means 27, as shown, due to its contact at the location 29, as noted. As can be seen, the rod means 27 obtains its support by passing through any type of aperture or slot provided within the nozzle housing structure, as at the region 30, which normally means that the rod means 27 will ordinarily be concealed, within the housing structure, since the front wall of the automatic shut-off, as at 31, generally conceals the same. A mount, as at 32, is seated or provided within the housing, and supports a pivot link 33, which pivots about the pin 34, with the upper portion of the pivot link, as at 35, disposed for biasing against the underside of the backing plate 18, as can be noted. The other leg of the pivot link, as at 36, has extending therethrough the back end of the rod means 27, and the rod means is normally biased forwardly, within its setting, by means of a biasing spring 37, as can be noted.

Thus, as can be determined, when the nozzle is not being used, and its bellows 8 is at its steady state condition, it is shifted forwardly of the spout 5, allowing the rod means 27 to shift forwardly, likewise, so that its pivot link 35 is pivoted upwardly, biasing against the underside of the backing plate 18, and shifts its diaphragm 15 upwardly, to maintain the nozzle in closure. Under this circumstance, the plunger 22 will be downwardly disposed, allowing the handle to remain shut off, in its configuration within the structure of the nozzle. Under these circumstances, the nozzle handle cannot be maneuvered to the on position.

But, when the nozzle is applied into the fill pipe of an automobile, or any vehicle, or even a container, its bellows 8 is compressed rearwardly, because of the pressure exerted upon its splashguard 9, that forces the rod means 27 rearwardly, against the bias of its spring 37, and under such condition, it pulls the lower leg 36 of the pivot link rearwardly, allowing the upper leg 35 of the pivot link to pivot downwardly, and clear the bottom of the backing plate 18. Thus, when that occurs, the spring 17 forces the diaphragm 15 downwardly, and forces its stem 20 downwardly, within the plunger 22, and which stages the nozzle into the condition for allowing for the initiation of fluid flow, when the handle 13 is pressed into an opened position. This normally occurs when the handle 13 is raised, within its guard 14, to allow for the opening of the poppet mechanism 11, to allow fluid, such as gasoline, to flow through the nozzle, and be dispensed into the gasoline tank of the vehicle in which the nozzle inserts.

Figure 3:
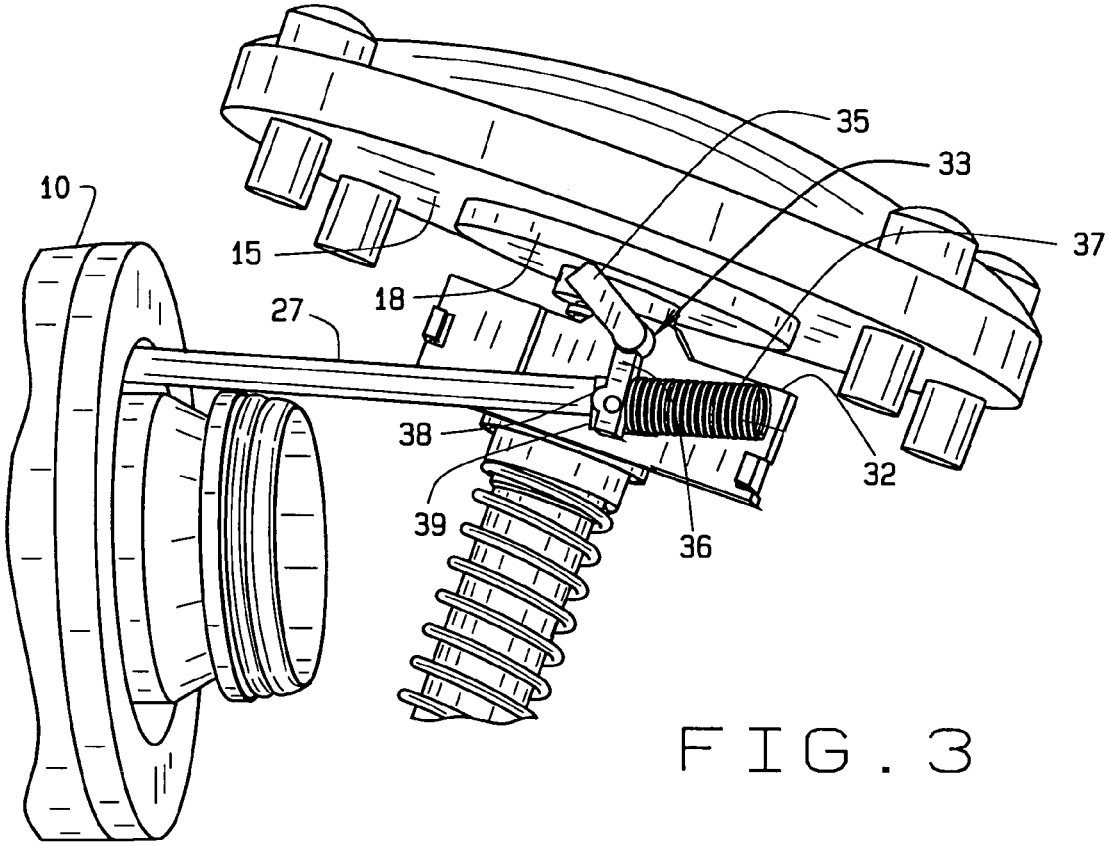
FIG. 3 shows a further enlarged view of the interlock system of this invention, during a non-dispensing condition, that holds the automatic shut-off into its fluid flow curtailing position, to prevent the untimely delivery of gasoline through and out of the nozzle, when maintained in such a setting.
Figure 4:
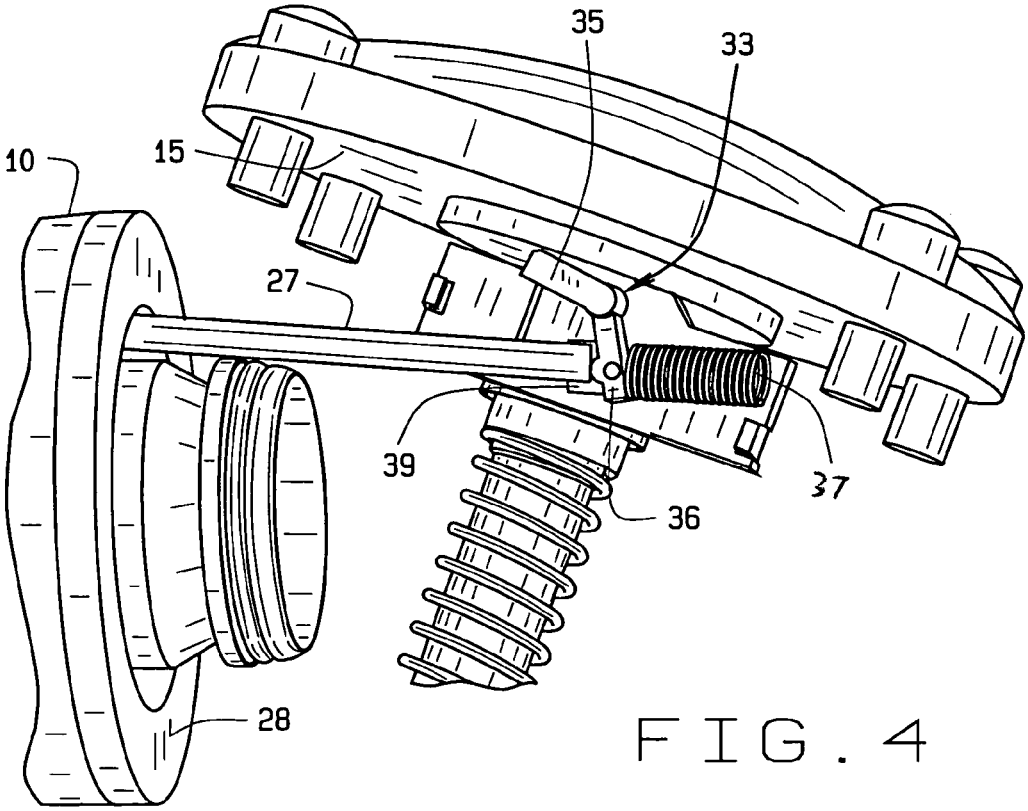
FIG. 4 shows the interlock system of this invention, activated, such as when the nozzle is located within the fill pipe of a vehicle, thereby disengaged from the automatic shut-off system, to allow for its normal application, during fluid dispensing, and to provide for automatic shut-off, when the fuel tank becomes full.

FIGS. 3 and 4 shows the sequence of operations of the nozzle interconnect of this invention. As can be seen in FIG. 3, the backend of the bellows housing 10, mounts upon the upper end of the spout, for the nozzle. The rod means 27 is shown extending into the nozzle housing, and is connected to or biasing against the boss 38 of the downward leg 36 of the pivotal link 33. As can be noted, the mount 32 of the interconnect has a cavity 39 provided therein, and it seats a compression spring 37 within that cavity. The spring biases against the backside of the lower leg 36 for the pivotal link 33. The upper leg 35, which is integral with the lower leg 36, also pivots with the pivotal link, when it is biased by the rod 27, depending which direction the rod 27 is shifted.

As previously stated, if the nozzle bellows 8 is pushed rearwardly, as when the nozzle is inserted into the fill pipe for a vehicle, then the rod means 27 pushes against the boss 38, shifts the lower leg 36 rearwardly, against the bias of the spring 37, which likewise pivots the upper leg 35 downwardly, clearing the underside of the backing plate 18. When this occurs, there is adequate clearance for the diaphragm 15 to shift downwardly, forcing the stem 20 down, relative to the plunger 22, so that the entire nozzle is now set up for the dispensing of fuel, once the handle 13 is compressed, and raised upwardly, for opening of the poppet means 11. This allows fuel to flow through the shown nozzle.

With this understanding, when the pivotal link is in the position as shown in FIG. 3, it is biasing against the bottom of the backing plate 18, forces the diaphragm 15 upwardly, which causes the stem 20 to be pulled upwardly, allowing the plunger 22 to move downwardly, for disengaging the nozzle, and to prevent the handle from being raised to dispense any fuel. Under this circumstance, the rod 27 is advanced to its forward most extent, the spout to the nozzle is not within the fill tank, and the bellows is fully expanded, so as to keep the upper leg 35 of the pivotal link in that contacting position. The force of the spring 37 forces the rod means 27 forwardly, and forces the bellows housing 10, forwardly, by movement of its back plate 28 into a forward position.

On the other hand, as can be seen in FIG. 4, when the bellows housing 10 is forced rearwardly, its back plate 28 urges the rod means 27 rearwardly, thereby forcing the lower leg 36 to press against the compression spring 40 allowing the pivotal means 33 to pivot, causing its up leg 35 to pivot downwardly. This allows clearance for the spring 17 to force the diaphragm 15 downwardly, which interengages the stem 20 and the plunger 22 together, through their bearings 24, as known in the art, and is also known in FIG. 2, and under this condition, the nozzle is ready for dispensing of fuel into the gasoline tank for the vehicle, because of its interconnection through the forced rearward movement of its bellows, biasing against the surface of the vehicle, or its fill pipe, during such application and usage.

Figure 5:
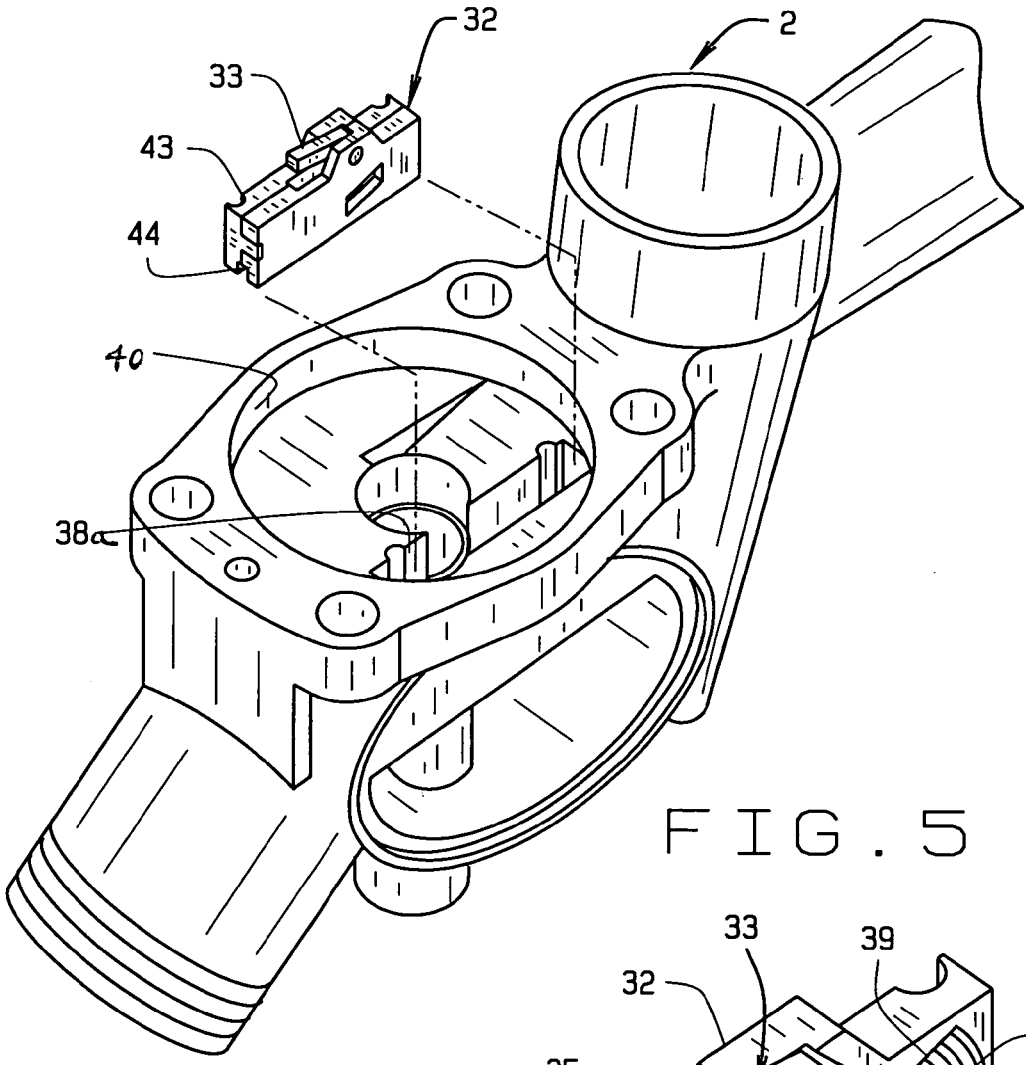
FIG. 5 provides an isometric view, showing the pivot link mount removed from its nozzle chamber.
Figure 6:
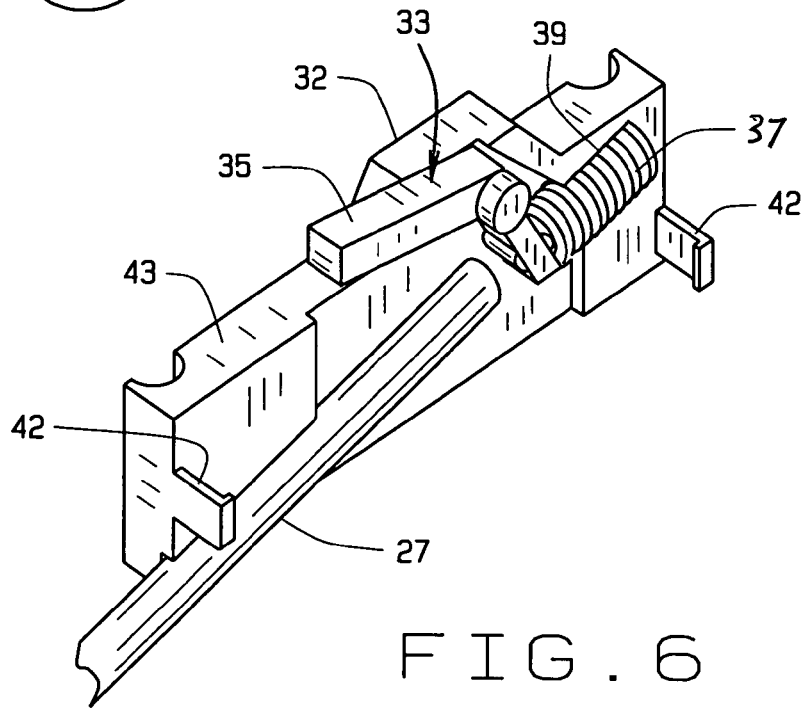
FIG. 6 provides an isometric view of the pivot link mount, with one side removed, to show the location of its operative components.

FIG. 5 shows a partial view of the nozzle body 2, showing the internal chamber 40 into which the diaphragm components of the automatic shut-off means locates during installation. Also disclosed is the chamber 38*a* that is milled or molded into the bottom of the chamber 40, and into which locates the mount 32 that holds the pivot link 33 for the operations as previously reviewed. As can be seen, the mount is actually made of two halves, as generally noted at 43 and 44, and which can come apart, to allow for installation of the pivot link 33, in addition to its spring 37. As can be noted from FIG. 6, the spring 37 sits within the cavity 39 provided within the back end of the mount 32. One half of the mount, the half 43, is shown in FIG. 6. The extension of the rod means 27 into the mount, through the nozzle housing, is also noted, and it can be seen how it is arranged for biasing against the lower leg 36 of the pivot link, while the upper leg 35 is also disclosed, and which when the spring 37 biases the pivot link 33 forwardly, as along its lower leg 36, the leg 35 pivots upwardly, and pushes against the underside of the backing plate 18, of the diaphragm, as previously described. The other half of the mount, 44, has been removed in FIG. 6, so as to disclose the internal operative components of the mount, and its pivot link, as shown and described. It can be noted that the two halves of the mount, 43 and 44, clamp together through the end clamps 42 provided upon the mount half 43.

Variations or modifications to the subject matter of this invention may occur to those skilled in the art upon review of the invention as described herein. Such variations, if within the spirit of this development, are intended to be encompassed within the scope of this invention as described. The invention as reviewed, and as summarized herein, and as depicted in the drawings, is set forth for illustrative purposes only.

The invention claimed is:

1. A nozzle for dispensing fuel from a fuel source into a container, such as a fuel tank, that has an inlet, the nozzle comprising:

a body which is formed having a passage for fuel flow through said body and an automatic biasing shutoff;

a spout attachable to said body in fluid communication with the fuel flow from said body, through said spout, and into a fuel tank;

a bellows having a back end, and fitting over said spout for biasing against the inlet of the container when said spout is inserted therein to prevent fuel vapors or fuel from splashing or escaping said nozzle;

a rod means mounting within said body for longitudinal shifting therethrough, and having a front end biasing against said back end of said bellows;

said rod means being forced by movement of said bellows either in a rearward direction, for disengaging said automatic shutoff of said nozzle in preparation for the dispensing of fuel from said nozzle, or when said bellows shifts in a forward direction, biasing said rod means into a forward direction to urge an engagement of said automatic shutoff to place said nozzle in a non-dispensing condition, preventing the flow of fuel through said nozzle and its delivery to a fuel tank during usage; and said rod means having a biasing pivotal link within a mount secured to said body beneath said shutoff, said pivotal link having an upper leg and an opposite lower leg, said upper leg contacting said shutoff, said lower leg being at an angle relative to said upper leg and contacting said rod means, a pivot, generally located between said upper leg and said lower leg and joined to said mount, and spring generally locating behind said lower leg opposite said rod means, said mount having two halves, spaced apart, and mutually parallel, said halves cooperating to form a cavity for admitting said spring therein, and said mount when installed in said body providing a clearance between said shutoff and said mount thereby permitting said pivotal link to rotate.

2. The fuel dispensing nozzle of claim 1 further comprising:

said lower leg having a boss for engaging the other end of said rod means.

3. A nozzle for dispensing fuel from a fuel source into a container, such as a fuel tank, that has an inlet, the nozzle comprising:

a body which is formed having a passage for fuel through said body and an automatic biasing shutoff;

a spout attaching to said body in fluid communication with fuel from said body and through said spout;

a bellows having a back end, and fitting over said spout for biasing against the inlet of the container when said spout is inserted therein to prevent vapors or fuel from escaping said nozzle;

a rod mounting within said body for longitudinal shifting therethrough, and having a front end biasing against said back end of said bellows and an opposite back end;

said rod being forced by movement of said bellows either rearward, for disengaging said automatic shutoff of said nozzle for dispensing fuel from said nozzle, or when said bellows shifts forward, biasing said rod into a forward direction urging an engagement of said automatic shutoff to place said nozzle in a non-dispensing condition, preventing the flow of fuel through the nozzle; and, a pivotal link biasing within a mount secured to said body beneath said shutoff and contacting said rod and said shutoff;

said pivotal link having an upper leg and an opposite lower leg, said upper leg contacting said shutoff, said lower leg being at an angle relative to said upper leg and contacting said rod, a pivot, generally located between said upper leg and said lower leg and joined to said mount, and a spring generally locating behind said lower leg opposite said rod; and said mount having two spaced apart mutually parallel halves, cooperating to form a cavity for admitting said spring, and when installed in said body, said mount providing a clearance for said pivotal link to rotate between said shutoff and said mount.

* * * * *